US006450294B1

(12) United States Patent
Liao

(10) Patent No.: US 6,450,294 B1
(45) Date of Patent: Sep. 17, 2002

(54) OIL REPLACEMENT ASSEMBLY WITH ANTI-DISORIENTATION CONNECTION DEVICE

(75) Inventor: Po-Lin Liao, Taichung (TW)

(73) Assignee: Lih Yann Co., Ltd., Taichung (TW)

( * ) Notice: Subject to any disclaimer, the term of this patent is extended or adjusted under 35 U.S.C. 154(b) by 27 days.

(21) Appl. No.: 09/751,615

(22) Filed: Dec. 28, 2000

(51) Int. Cl.[7] ..... F16N 7/14
(52) U.S. Cl. ..... 184/1.5; 141/98
(58) Field of Search ..... 184/1.5, 6.1, 7.4, 184/81; 137/270, 884; 141/65, 98, 367; 123/196 R

(56) References Cited

U.S. PATENT DOCUMENTS 5,626,170 A * 5/1997 Parker ..... 141/367
6,082,416 A * 7/2000 Viken ..... 184/1.5
6,131,701 A * 10/2000 Camacho et al. ..... 184/1.5
6,244,384 B1 * 6/2001 Few ..... 141/98
6,330,934 B1 * 12/2001 Viken ..... 141/98

* cited by examiner

*Primary Examiner*—Chong H. Kim

(57) ABSTRACT

An oil replacement assembly includes a housing in which a plurality of circuits and gauges are incorporated therein. An inner one-way valve is arranged between a first connecting port and a third connecting port of a 9-way valve, while a second inner one-way valve is arranged between a second connecting port and a fourth connecting port of the 9-way valve. An eighth connecting port of said 9-way valve is connected to the first connecting port, and is further connected to a dual-3-way valve. A fifth connecting port and a second connecting port are connected to another port of the dual-3-way valve, while another port of the dual-3-way valve is connected to a sixth connecting port of the 9-way valve. Wherein when the first connecting port and the second connecting port are incorrectly connected, contaminated oil received in the second connecting port will be redirected back to the first connecting port.

3 Claims, 9 Drawing Sheets

OIL REPLACEMENT ASSEMBLY WITH ANTI-DISORIENTATION CONNECTION DEVICE

FIELD OF THE INVENTION

The present invention relates to an oil replacement assembly, and more particularly to an oil replacement assembly with anti-disorientation connection device thereby properly protecting the assembly from being damaged when the inlet and outlet are incorrectly connected.

DESCRIPTION OF THE PRIOR ART

Periodically changing oil in a gearbox or engine is a mandatory requirement for a trouble-free running of a vehicle because the oil is contaminated by metal debris resulted from frictional engagement of moving parts. In addition, the property of the oil is also deteriorated under high-pressure and high-temperature. Before refill of the fresh oil, it is also suggested to "wash-off" the entire gearbox with fresh oil to ensure the gearbox is completely free from any contaminated used oil. This standard procedure is laborious and time consuming. In addition, if the contaminated used oil is not correctly handled, the environment might be polluted.

Generally, an oil replacement assembly includes an inlet and an outlet corresponding to an inlet and an outlet of the gearbox. The internal circuits of the oil replacement assembly is designed that the used oil is received through outlet of the assembly, while the inlet of the assembly should be connected to the inlet of the gearbox. If the inlet and outlet circuits are incorrectly connected, not only will the gearbox not be replaced with clean oil, but also will contaminate internal circuits of the assembly. However, this incorrect connection does happen because of incorrect operation of the assembly, especially when the operator is not well trained.

SUMMARY OF THE INVENTION

It is an objective of this invention to provide an oil replacement assembly in which an one-way valve is provided such that contaminated oil will be automatically conveyed to a waste oil tank even the inlet/outlet is incorrectly connected.

In order to achieve the objective set forth, an oil replacement assembly includes a housing in which a plurality of circuits and gauges are incorporated therein. An inner one-way valve is arranged between a first connecting port and a third connecting port of a 9-way valve, while a second inner one-way valve is arranged between a second connecting port and a fourth connecting port of the 9-way valve. An eighth connecting port of said 9-way valve is connected to the first connecting port, and is further connected to a dual-3-way valve. A fifth connecting port and a second connecting port are connected to another port of the dual-3-way valve, while another port of the dual-3-way valve is connected to a sixth connecting port of the 9-way valve. Wherein when the first connecting port and the second connecting port are incorrectly connected, contaminated oil received in the second connecting port will be redirected back to the first connecting port.

BRIEF DESCRIPTION OF PREFERRED EMBODIMENT

Other objects and advantages of the present invention will become apparent from the following detailed description of the preferred embodiments thereof taken in conjunction with the accompanying drawings wherein.

DETAILED DESCRIPTION OF PREFERRED EMBODIMENT

Figure 1:
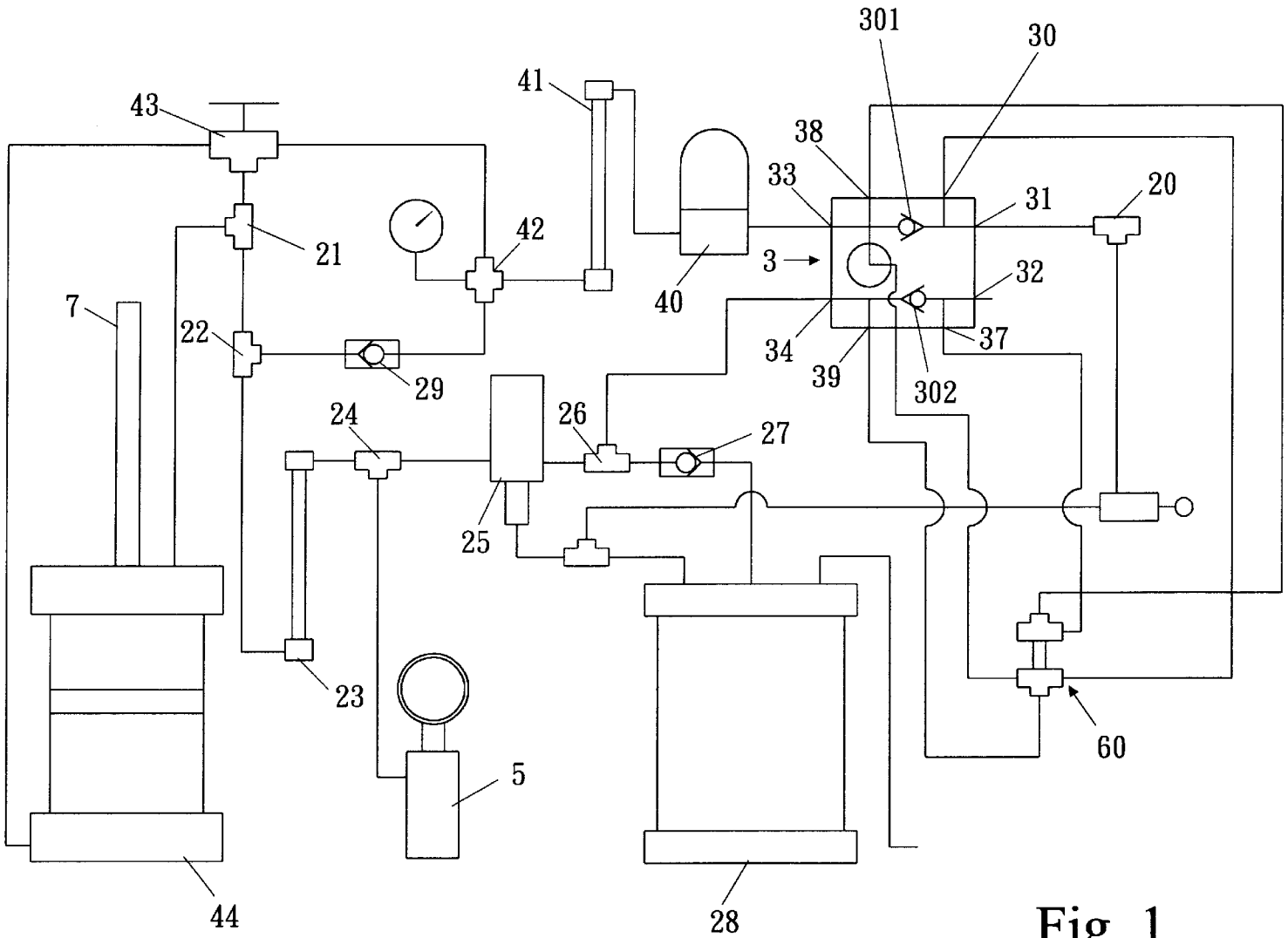
FIG. 1 is a circuit diagram of an oil replacement assembly made in accordance with the present invention.

Referring to FIGS. 1–6, an oil replacement assembly in accordance with the present invention generally comprises a housing 1 in which a plurality of circuits and gauges are incorporated therein. The circuits generally includes a 9-way valve 3. A first connecting port 31 of the 9-way valve 3 is connected with a first 3-way valve 20, while a third connecting port 33 is connected with a sieve 40. A first gauge 41 and a 4-way valve 42 are connected to the sieve 40 in series. A 3-way valve 43 is connected to the 4-way valve 42, and is further connected to a cylinder 44. A second 3-way valve 21 is connected to the 3-way valve 43. A third 3-way valve 22, a second gauge 23, a fourth 3-way valve 24, an oil tank 25, a fifth 3-way valve 26, a first one-way valve 27 are all connected in series after the second 3-way valve 21. A waste tank 28 is connected to the one-way valve 27. Wherein one port of the second 3-way valve 21 is connected to the cylinder 44, while one port of the third 3-way valve 22 is connected to a second one-way valve 29 which is in turn connected to one port of the 4-way valve 42. A port of the fourth 3-way valve 24 is connected to a pump 5 through another circuit. Another port of the fifth 3-way valve 26 is redirected to a fourth port 34 of the 9-way valve 3. Specially, an internal one-way valve 301 is arranged between the first connecting port 31 and the third connecting port 33, while a second internal one-way valve 302 is arranged between a second connecting port 32 and the fourth port 34 of the 9-way valve 3. In addition, the second internal one-way valve 302 is open to a circuit between an eighth connecting port 30 and the first connecting port 31. The second internal one-way valve 302 is further connected to a dual-3-way valve 60. A fifth connecting port 37 and the second connecting port 32 have the same diameter, and are further directed to a connecting port of the dual-3-way valve 60. Another connecting port of the dual-3-way valve 60 is directed to a sixth connecting port 38 of the 9-way valve 3.

Figure 2:
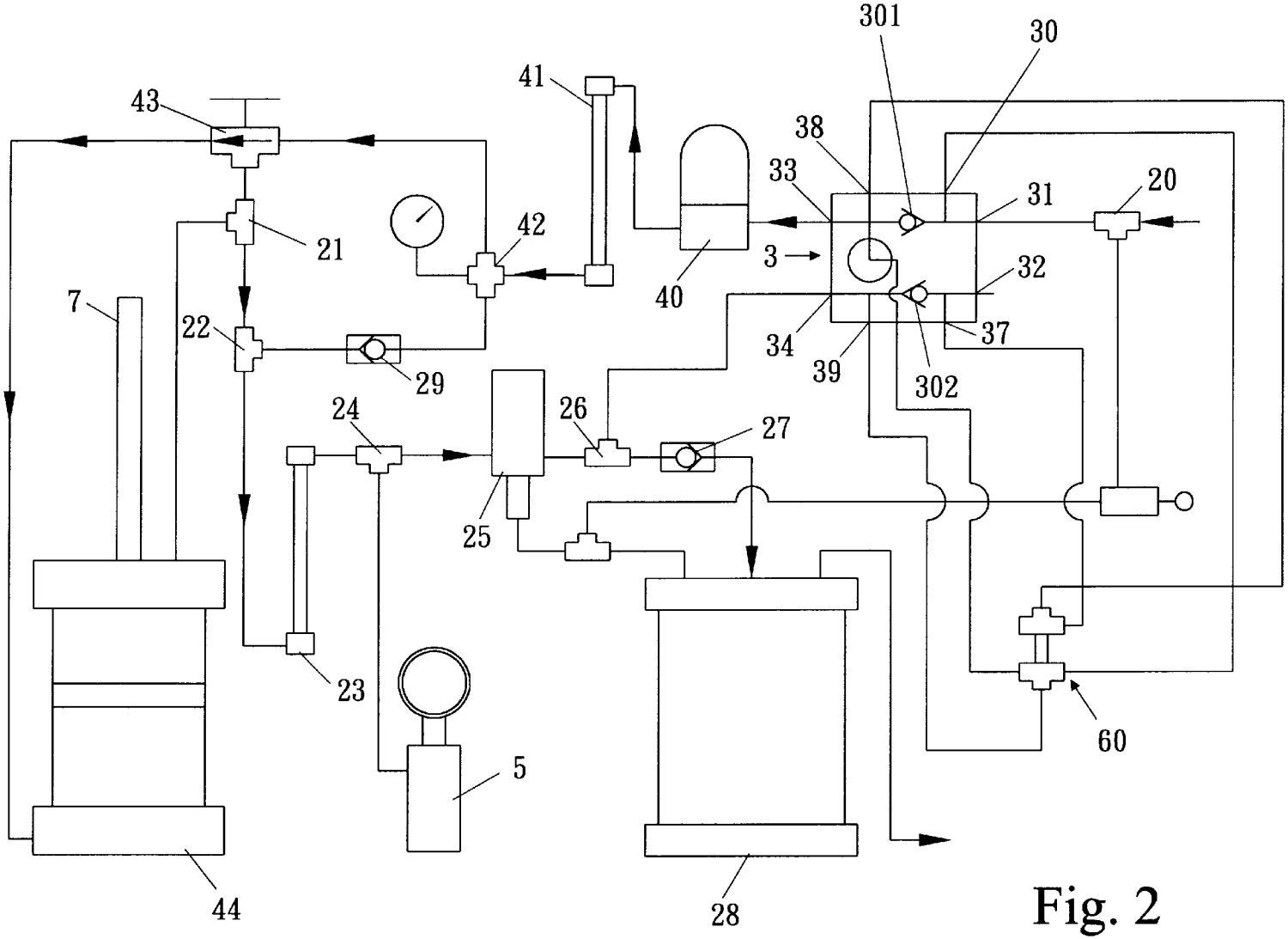
FIG. 2 is a circuit diagram in which contaminated oil is conveyed through a correct flow path.
Figure 3:
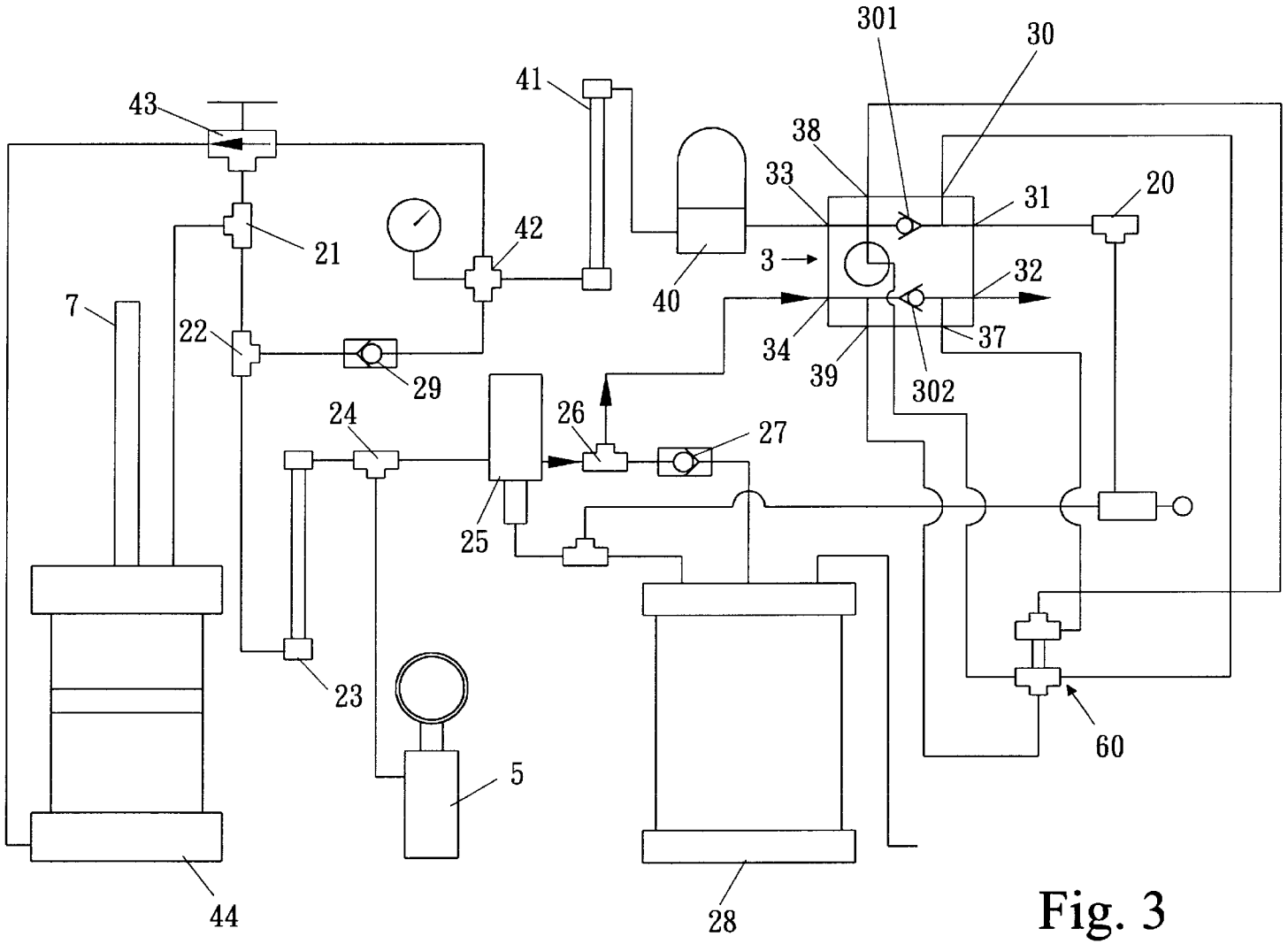
FIG. 3 is a circuit diagram showing a flow path of fresh oil for flushing through a gearbox.
Figure 4:
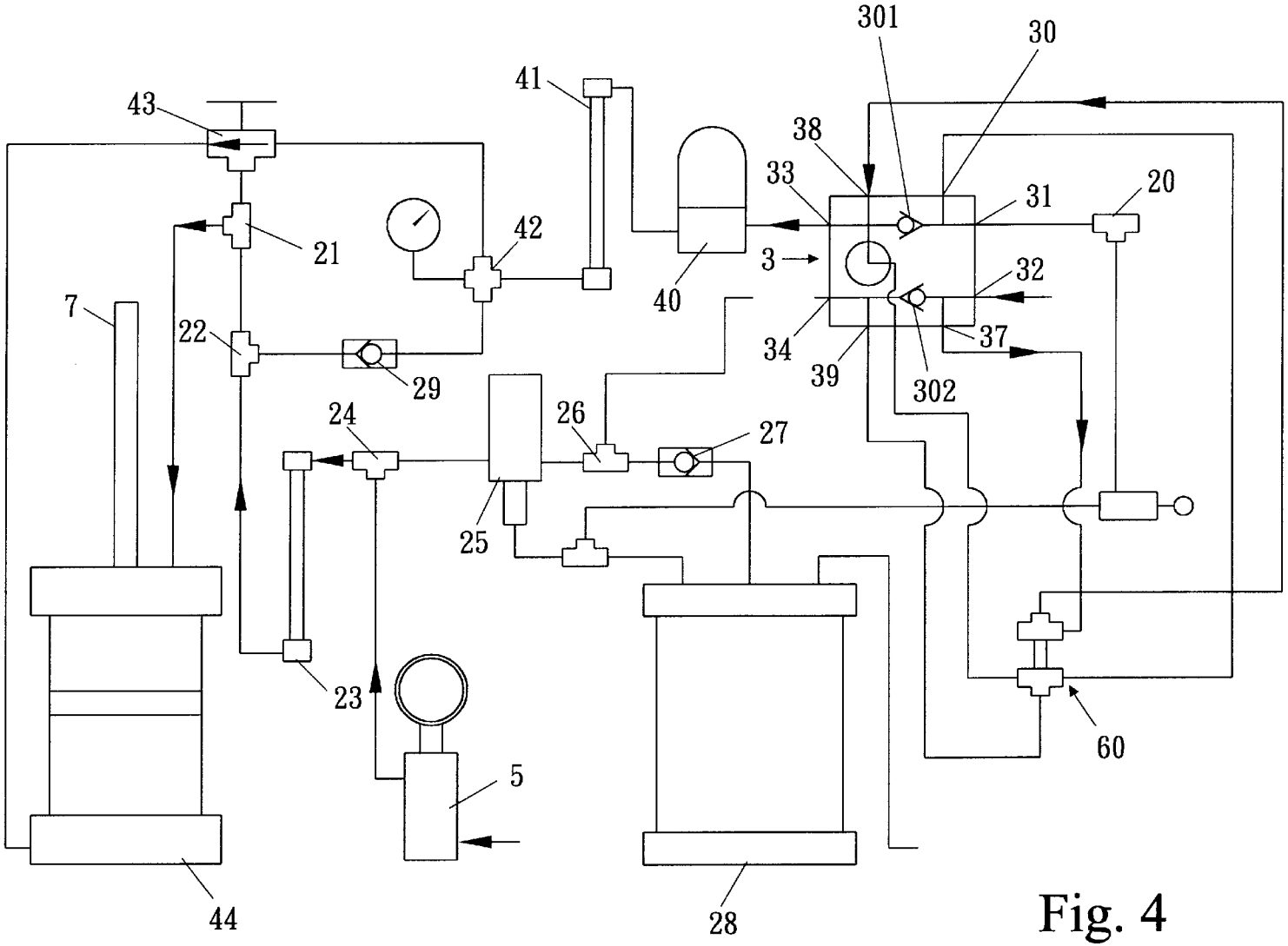
FIG. 4 is a circuit diagram showing a flow path of fresh oil for refilling the gearbox.

As shown in FIG. 2, when contaminated used oil is to be discharged from a gearbox, an outlet of the gearbox is connected to the first connecting port 31 of the 9-way valve 3, while an inlet of the gearbox is connected to the second connecting port 32. Accordingly, the contaminated oil is sucked into the circuit and flow through the first 3-way valve 20, a first connecting port 31 of the 9-way valve 3, the third connecting port 33, the sieve 40, the first gauge 41, the 4-way valve 42, the first 3-way valve 43. A portion of the contaminated oil is directed to the cylinder 44, while the rest of the contaminated oil is directed to the second 3-way valve 21, the third 3-way valve 22, the second gauge 23, the fourth 3-way valve 24, the oil tank 25, the fifth 3-way valve 26, the first one-way valve 27, and finally into the waste tank 28.

After the contaminated oil is discharged from the gearbox, detergent is added into the oil tank 25. As a matter of fact, the detergent is added when the contaminated oil is discharged from the gearbox. The detergent flows from the oil tank 25, then into the fifth 3-way valve 26, the fourth port 34 of the 9-way valve 3, the second connecting port 32, and then to the inlet of the gearbox. Consequently, through the flushing process, the gearbox can be easily cleaned.

After the gearbox is cleaned, fresh oil is refilled into the gearbox. The fresh oil is added into the system through a pump 5 connected to a port of the fourth 3-way valve 24. The fresh oil is then pumped to the fourth 3-way valve 34, the second gauge 23, the third 3-way valve 22, the second 3-way valve 21, and then into the cylinder 44. The fresh oil then flows through the first 3-way valve 43, the 4-way valve 42, the first gauge 41, the sieve 40, and the third connecting port 33 of the 9-way valve 3, and finally into the inlet of the gearbox through the first connecting port 31 of the 9-way valve 3, and the first 3-way valve 20.

Figure 5:
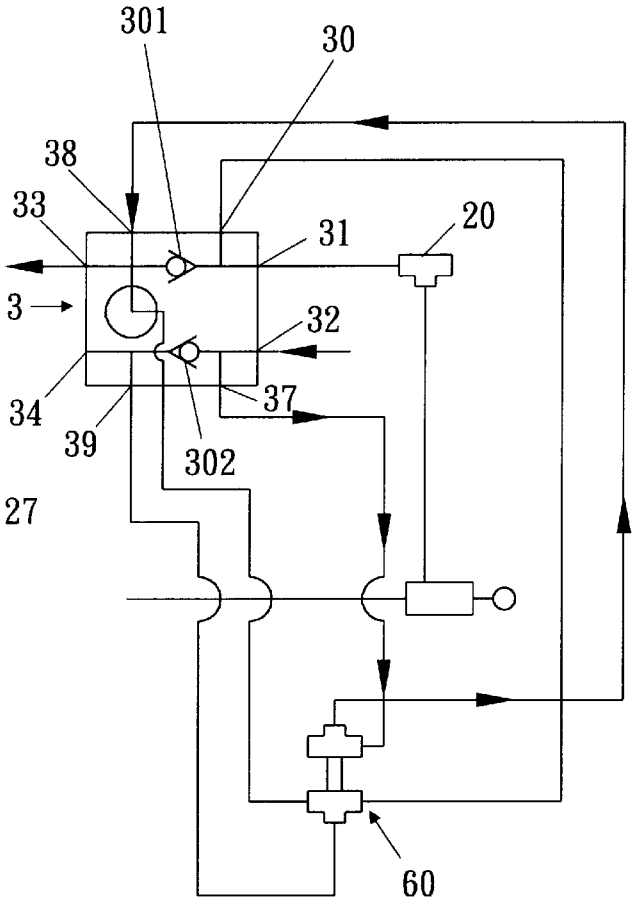
FIG. 5 is a circuit diagram showing a flow path when inlet/outlet are incorrectly connected, while contaminated oil is still correctly directed to a waste tank.
Figure 6:
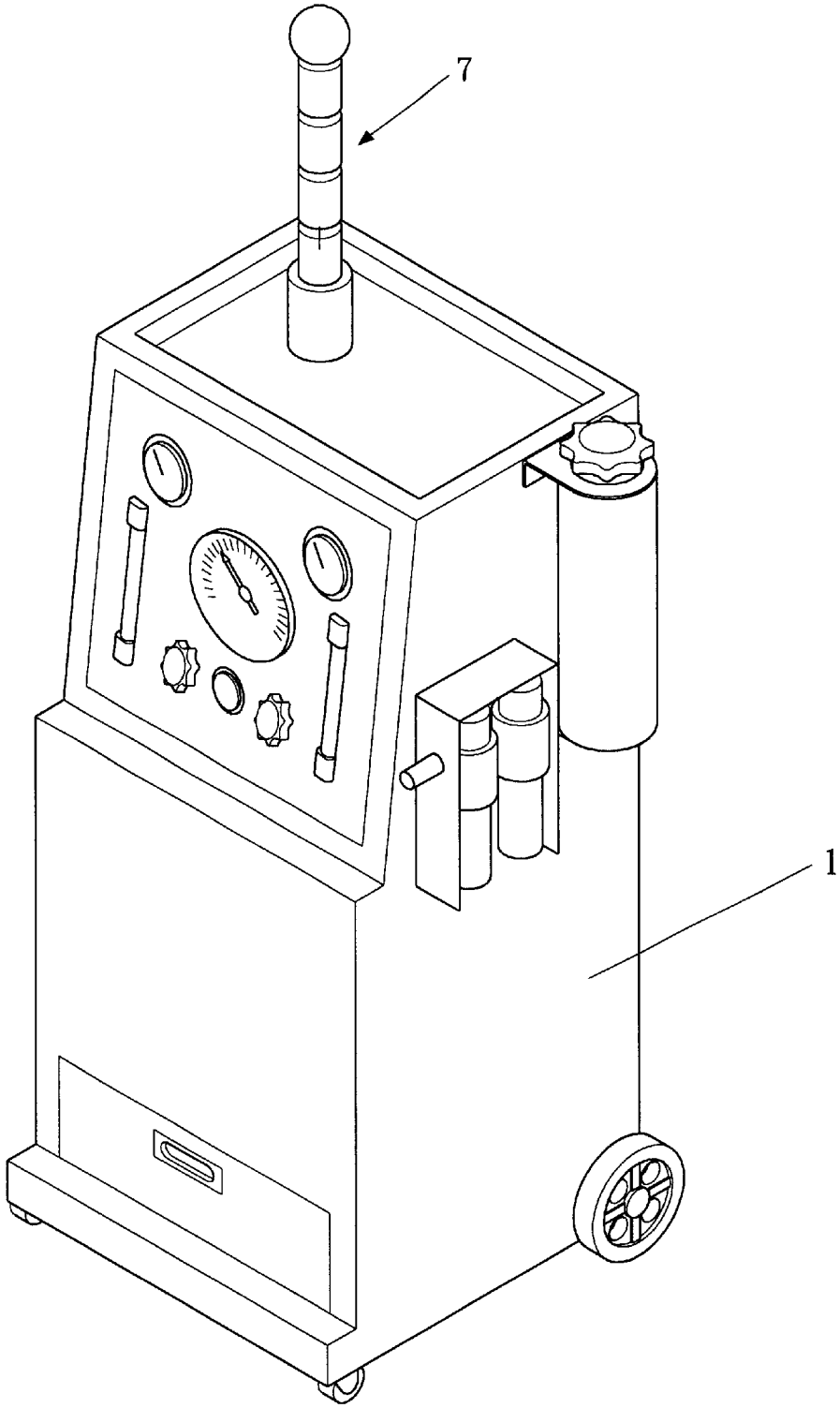
FIG. 6 is a perspective view of FIG. 1.

However, if the first connecting port 31 to the inlet, while the second connecting port 32 is connected to the outlet, by the provision of the present invention, the contaminated oil can still be corrected discharged from the gearbox, while the fresh oil can still be refilled to the gearbox without any problem. Referring to FIG. 5, when the contaminated oil flows into the system through the second connecting port 32 of the 9-way valve 3, since there is an one-way valve 36, the contaminated oil can not flow through, but redirected to the fifth connecting port 37. Then the contaminated oil then flows through the dual-3-way valve 60, and then flows back to the 9-way valve 3 through the sixth connecting port 38. As a result, the contaminated oil again flows back to the 9-way valve 3, and flow out off the 9-way valve 3 through the second connecting port 32. Accordingly, even the first and second connecting ports 31, 32 are incorrectly connected, the contaminated oil is correctly redirected to its intended path. The conventional problem is then completely solved.

Figure 7:
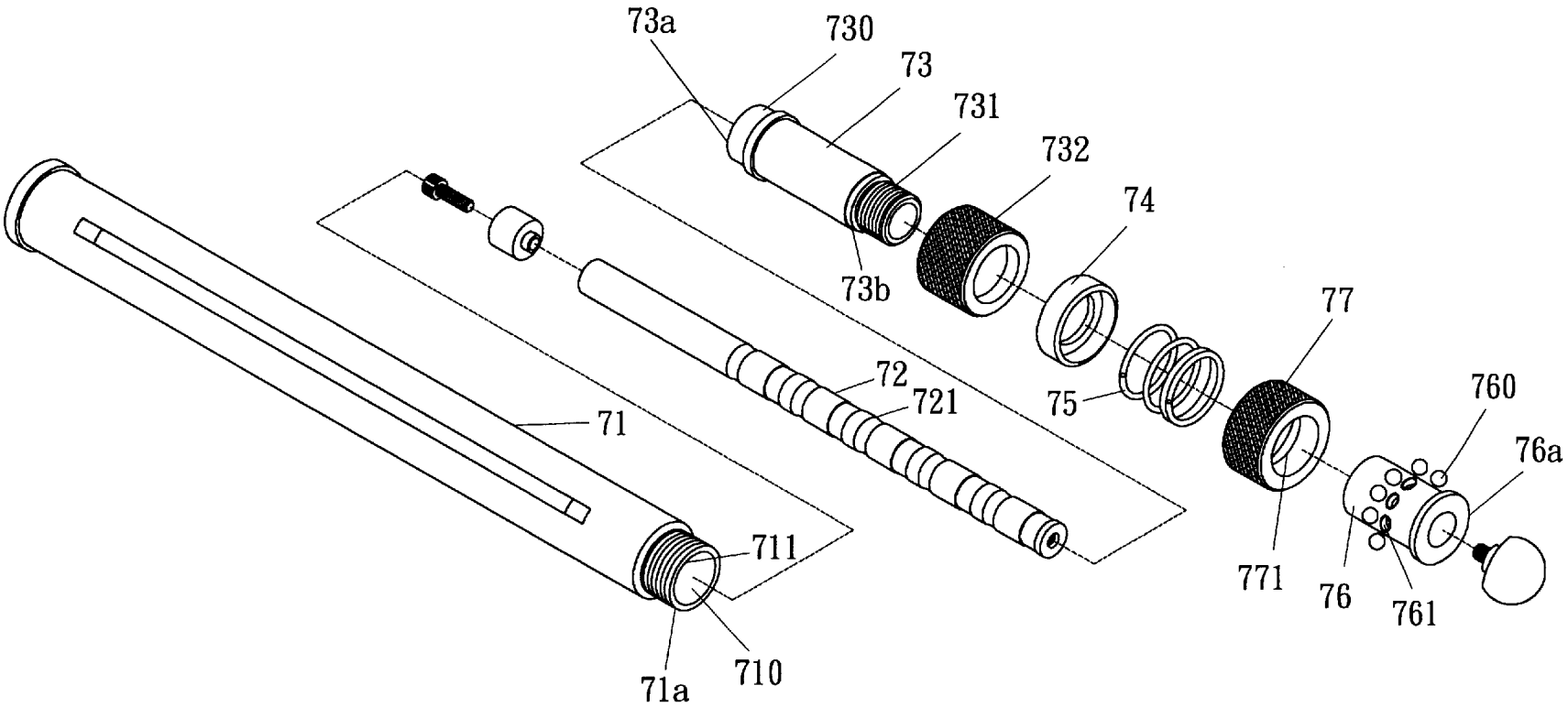
FIG. 7 is a perspective view showing an automatic oil metering device used with the oil replacement assembly in accordance with the present invention.
Figure 8:
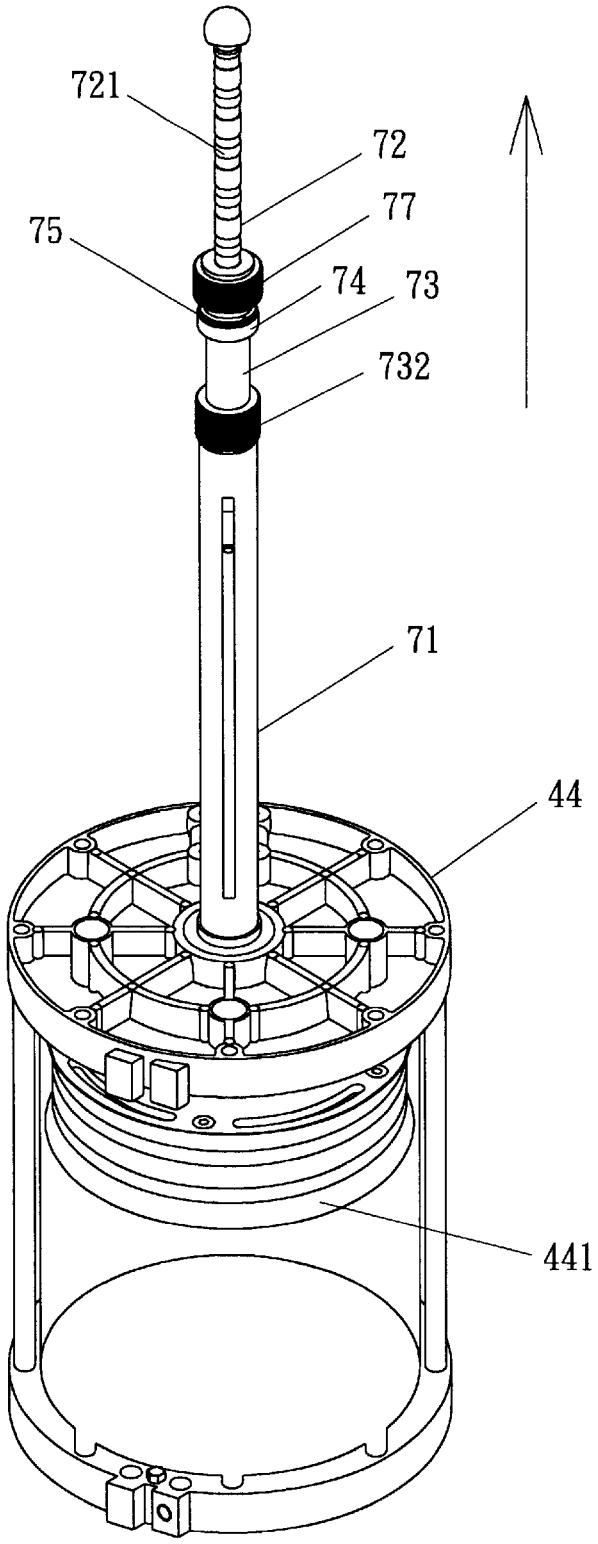
FIG. 8 is a perspective view showing the metering device is in one working position.
Figure 9:
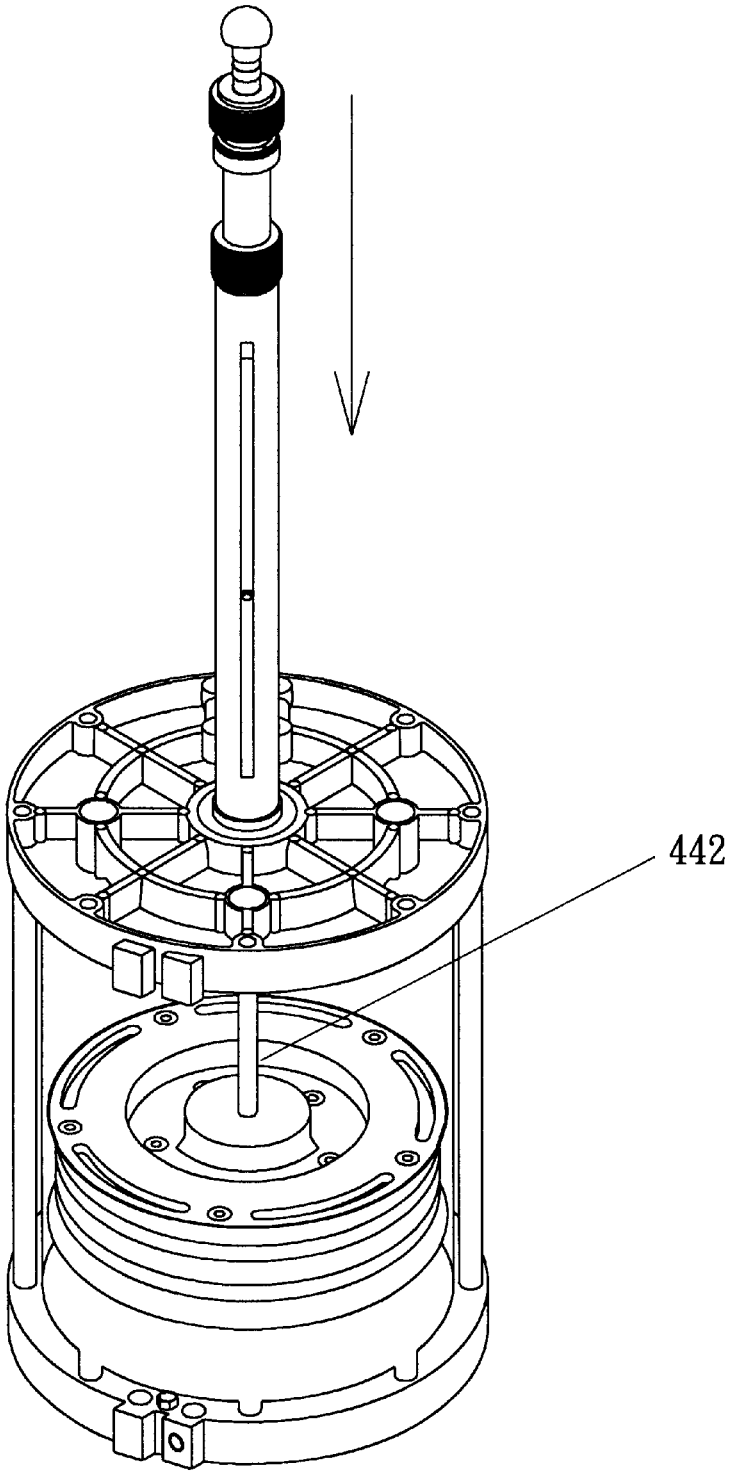
FIG. 9 is a perspective view showing the metering device is in another working position.

Referring to FIGS. 7, 8 and 9, an automatic oil metering device 7 is disclosed. The metering device 7 generally comprises a cylindrical housing 71 having a threaded end 71. A metering rod 72 having metering grooves 721 arranged on outer wall thereof is moveably disposed within the cylindrical housing 71. A barrel 73 is enveloped onto the metering rod 72, and an end 730 thereof is inserted into an end 710 of the cylindrical housing 71 with a rib 73*a* abuts against the end wall 71*a* of the threaded portion 711. The other end of the barrel 73 is provided with threaded portion 731. A first threaded collar 732 is enveloped onto the barrel 73 to fixedly attach the barrel 73 to the cylindrical housing 71. The first threaded collar 732 is threaded with the threaded portion 711 of the cylindrical housing 711 such that the rib 73*a* is pressed against to the end wall 71*a*. The threaded portion 731 is provided with a shoulder 73*b* on which a supporting collar 74 is seated. A spring 75, and an adjusting collar 77 is then enveloped onto the barrel 73 and pressed against to the spring 75. A bearing tube 76 is attached to the threaded portion 731 of the barrel 73 such that the adjusting collar 77 is moveable along the bearing tube 76. The bearing tube 76 includes a flange 76*a* which prevent the adjusting collar 77 and the spring 75 from escaping from the bearing tube 76.

The bearing tube 76 is provided with a plurality of recesses 761 in which bearing balls 760 are inserted. The adjusting collar 77 is provided with an inner groove 771 which is corresponding to the recesses 761 and balls 760 arrangement. The recesses 761 and bearing balls 760 are arranged such that when the adjusting collar 77 is moved against the spring 75, an inner diameter of the bearing tube 76 can be resumed as the balls 760 move out from the recesses 761. Accordingly, the inner diameter of the bearing tube 76 is not effected. When the adjusting collar 77 is pushed back by the spring 75, the balls 760 are pushed back to the recesses 761 such that portions of the balls 760 extend into inner wall of the bearing tube 76, thereby reducing the inner diameter of the bearing tube 76. As described above, the metering rod 72 is provided with the metering grooves 721 which receives the inserted portions of the balls 760. Accordingly, the metering rod 72 can be selectively positioned with respect to the bearing tube 76.

The metering device 7 can be used with the oil replacement assembly 1 described above. An end of the metering rod 72 is linked to a metering disk 441 of the cylinder 44 by a linking rod 72. In operation, the metering rod 72 can be set to a desired position with the adjusting collar 77 being pushed against the spring 75 to release the balls 760 from the recesses 761. As a result, the metering disk 441 can be readily set to the desired position. After that, the adjusting collar 77 is released, thereby the metering rod 72 is locked again with the engagement between the balls 761 and the metering groove 721, as clearly shown in FIGS. 8 and 9. Consequently, the oil delivered to the gearbox can be correctly set.

While specific illustrated embodiment has been shown and described, it will be appreciated by those skilled in the-art that various modifications, changes, and additions can be made to the invention without departing from the spirit and scope thereof as set forth in the following claims.

I claim:

1. An oil replacement assembly comprising a housing in which a plurality of circuits and gauges are incorporated therein, said circuits generally including a 9-way valve, a first connecting port of said 9-way valve being connected to a first 3-way valve, while a third connecting port of said 9-way valve being connected with a sieve, a first gauge and a 4-way valve being connected to said sieve in series, a cylinder being connected to said first 3-way valve, another port of said first 3-way valve being connected to a second 3-way valve, a third 3-way valve, a second gauge, a fourth 3-way valve, an oil tank, a fifth 3-way valve, a first one-way valve, and to an waste tank, wherein said second 3-way valve is connected to said cylinder, while said third 3-way valve is connected to a port of said 4-way valve through a second one-way valve, another port of said 4-way valve being connected to a pump;

one port of said fifth 3-way valve being connected to a fourth port of said 9-way valve; characterized in that an inner one-way valve is arranged between said first connecting port and a third connecting port of said 9-way valve, while a second inner one-way valve is arranged between said second connecting port and a fourth connecting port of said 9-way valve, an eighth connecting port of said 9-way valve being connected to said first connecting port, and further connected to a dual-3-way valve, said fifth connecting port and said second connecting port being connected to another port of said dual-3-way valve, another port of said dual-3-way valve being connected to a sixth connecting port of said 9-way valve.

2. An oil replacement assembly as recited in claim 1, wherein said second connecting port and said fifth connecting port have the same diameter.

3. An oil replacement assembly as recited in claim 1, further including a metering device generally having a cylindrical housing with a threaded end thereof;

a metering rod having metering grooves arranged on outer wall thereof and moveably disposed within said cylindrical housing, a barrel enveloped onto said metering rod with an end thereof inserted into an end of said cylindrical housing, another end of said barrel being provided with threaded portion, a first threaded collar being enveloped onto said barrel for fixedly attaching said barrel to said cylindrical housing, a supporting collar, a spring and an adjusting collar being attached to said threaded portion of said barrel by a bearing tube such that said adjusting collar being moveable along said bearing tube, said bearing tube being provided with a plurality of recesses in which bearing balls are seated, said adjusting collar being provided with an inner groove corresponding to said recesses and balls arrangement, wherein said recesses and bearing balls are arranged such that when said adjusting collar is moved against said spring, an inner diameter of said bearing tube can be resumed as said balls move out from said recesses, while when said adjusting collar is pushed back by said spring, said balls being pushed back into said recesses such that portions of said balls extend into inner wall of said bearing tube thereby engaging with said metering groove of said metering rod for positioning said metering rod with respect to said barrel.

* * * * *